US006053846A

United States Patent [19]

Lin

[11] Patent Number: 6,053,846

[45] Date of Patent: Apr. 25, 2000

[54] WRIST EXERCISER

[76] Inventor: Chien-Der Lin, No. 1-3, Lane 251, Tong-Yeang Road, Fong-Yuan, Taichung, Taiwan

[21] Appl. No.: 09/362,562

[22] Filed: Jul. 28, 1999

[51] Int. Cl.[7] ..... A63B 5/00; A63B 21/22

[52] U.S. Cl. ..... 482/44; 482/45; 482/110

[58] Field of Search ..... 482/44–46, 49, 482/50, 110, 114, 121, 133, 908, 148, 92

[56] References Cited

U.S. PATENT DOCUMENTS

| | | | |
|---|---|---|---|
| 4,684,124 | 8/1987 | Escher | 482/110 |
| 4,858,912 | 8/1989 | Boyd | 482/45 |
| 5,399,136 | 3/1995 | Bart | 482/110 |
| 5,800,311 | 9/1998 | Chuang | 482/44 |
| 5,807,215 | 9/1998 | Abe et al. | 482/110 |

*Primary Examiner*—Stephen R. Crow

*Attorney, Agent, or Firm*—Browdy and Neimark

[57] ABSTRACT

A wrist exerciser comprises a lower shell and an upper shell. The lower shell is semispherical and provided therein with a support ring and a rotary member. The upper shell is hollow and semispherical and provided in the top thereof with a round opening. The lower shell is provided with two lower protruded plate members extending therefrom symmetrically and having a first through hole. The upper shell is provided with two upper protruded plate members corresponding to the lower protruded plate members and having a second through hole opposite to the first through hole. The second through hole is provided in the periphery thereof with a plurality of second columnar bodies, each having a hole. The upper protruded plate members and the lower protruded plate members are fastened together by a plurality of screws which are fastened into the holes of the second columnar bodies via the through holes of the first columnar bodies.

1 Claim, 10 Drawing Sheets

WRIST EXERCISER

FIELD OF THE INVENTION

The present invention relates generally to a game device, and more particularly to a wrist exerciser.

BACKGROUND OF THE INVENTION

As shown in FIGS. 1–3, a wrist ball 10 of the prior art comprises mainly a semispherical lower shell 11 of a transparent plastic material, a bracing ring 12 disposed in the inside of the top end of the lower shell 11, a rotary the inside of the top end of the lower shell 11, a rotary member 13 provided with a center shaft 131 and a groove 132 extending along the outer periphery thereof and having a hole 133. The rotary member 13 is received in the bracing ring 12 such that both ends of the center shaft 131 are fastened pivotally with the bracing ring 12. A transparent upper shell 14 of a plastic material is joined with the top end of the lower shell 11 and is provided in the top thereof with a round opening 141.

As shown in FIG. 4, a cord 20 has a head end 25, which is inserted into the hole 133 of the rotary member 13. Now referring to FIG. 5, the rotary member 13 is shown being pressed by the thumb. In the meantime, the cord 20 is wound in the groove 132 along the direction indicated by an arrow 24 such that only a small segment of the cord 20 remains outside. As shown in FIG. 6, the wrist ball 10 is held in one hand while the cord 20 is pulled forcefully with other hand along the direction indicated by an arrow 21, so as to actuate the rotary member 13 to turn in the direction indicated by an arrow 22 as shown in FIG. 7. The rotary member 13 and the bracing ring 12 are also actuated by the centrifugal force to turn in the direction indicated by an arrow 23 as shown in FIG. 8. At this moment, the wrist ball 10 is held in the palm in time, as shown in FIG. 9, such that the arm remains stationary, and that the palm is rotated on the "A" point serving as a fulcrum, so as to cause the wrist ball 10 to rotate clockwise along a circumferential track in an uninterrupted manner for testing a player's perseverance. As the wrist ball 10 is rotated forcefully, the rotational speed of the rotary member 13 accelerates to as fast as 8000 revolutions per minute. It must be noted here that wrist ball 10 buzzes at the time when the rotation of the rotary member 13 accelerates. As the palm stops turning, the rotary member 13 decelerates gradually to a complete stop.

SUMMARY OF THE INVENTION

This inventor of the present invention has been engaged in the activities of making the game device described above. Accordingly, this inventor of the present invention feels strongly that the game device must be constantly improved. A wrist exerciser is thus disclosed for use by both hands of a user thereof.

The features of the present invention are explained in detail by the embodiments with reference to the accompanying drawings.

DETAILED DESCRIPTION OF THE EMBODIMENTS

Figure 1:
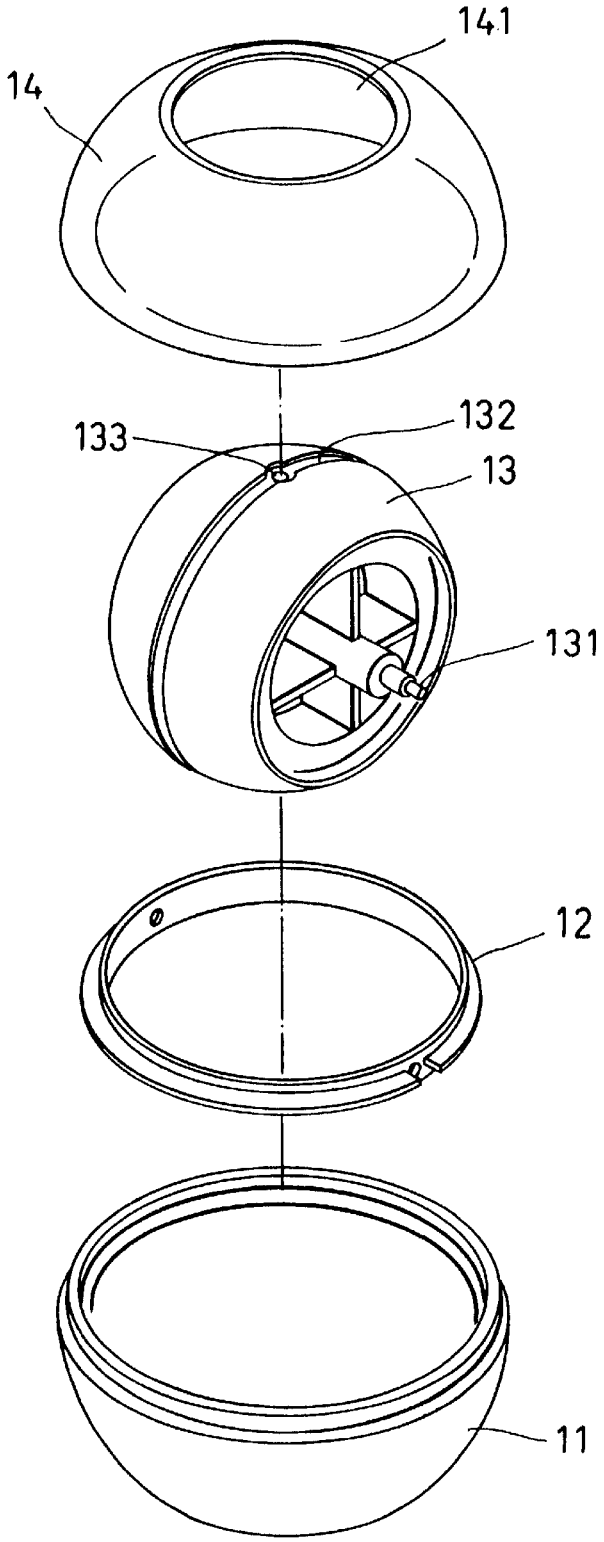
FIG.1 (PRIOR ART)
FIG. 1 shows an exploded view of a wrist ball of the prior art.
Figure 3:
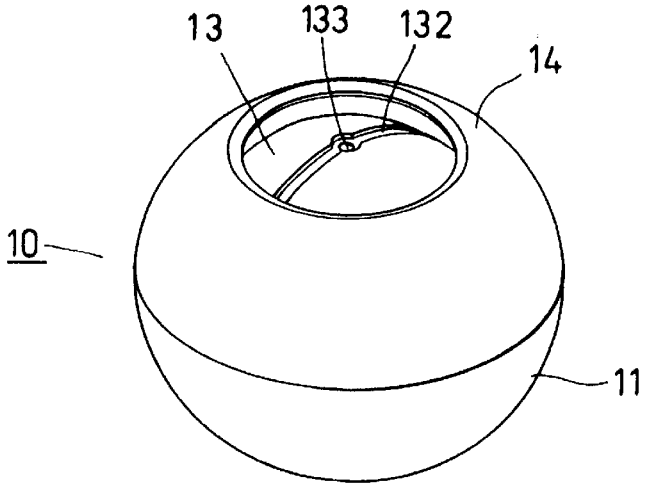
FIG.3 (PRIOR ART)
FIG. 3 shows a complete perspective view of the prior art wrist ball in combination.
Figure 2:
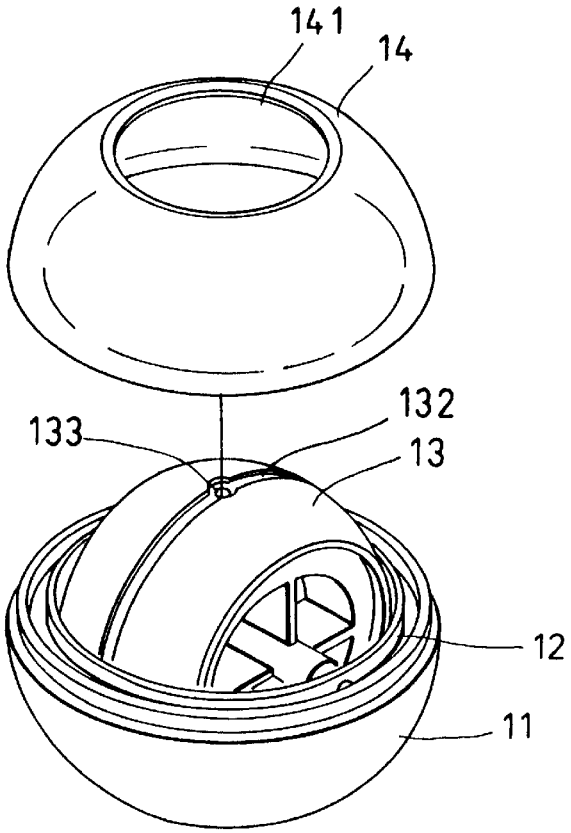
FIG.2 (PRIOR ART)
FIG. 2 shows a partial perspective view of the prior art wrist ball in combination.
Figure 4:
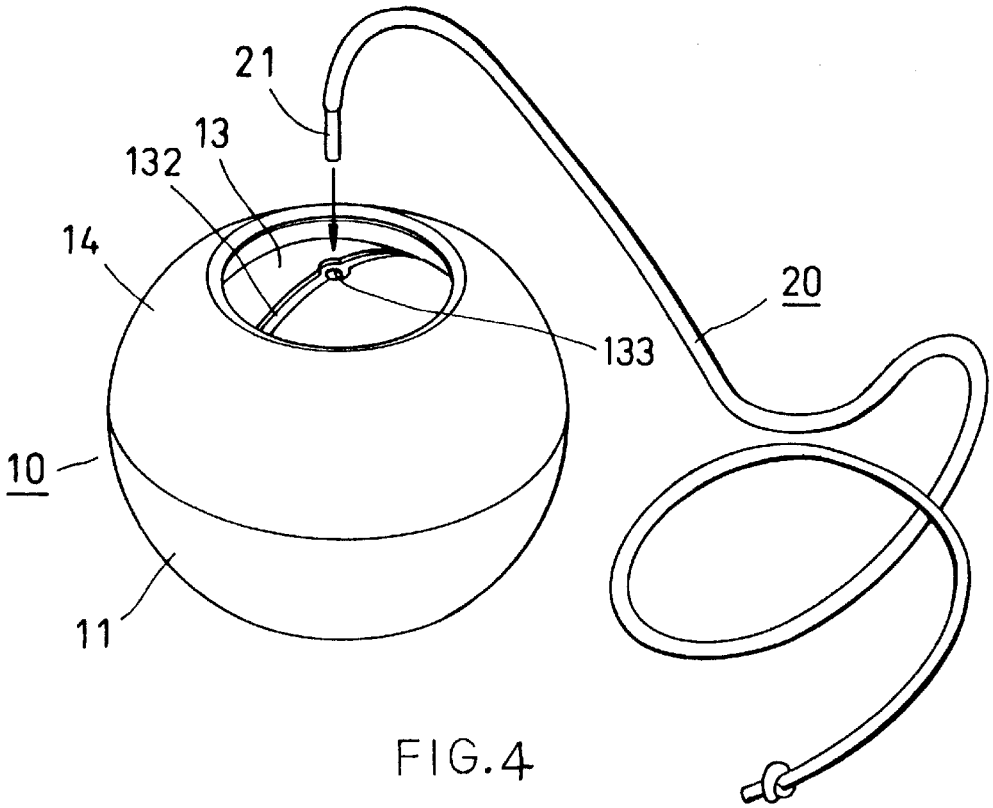
FIG.4 (PRIOR ART)
FIG. 4 is a schematic view showing that the head end 25 of a cord 20 is about to be inserted into a hole 133 of the prior art wrist ball.
Figure 6:
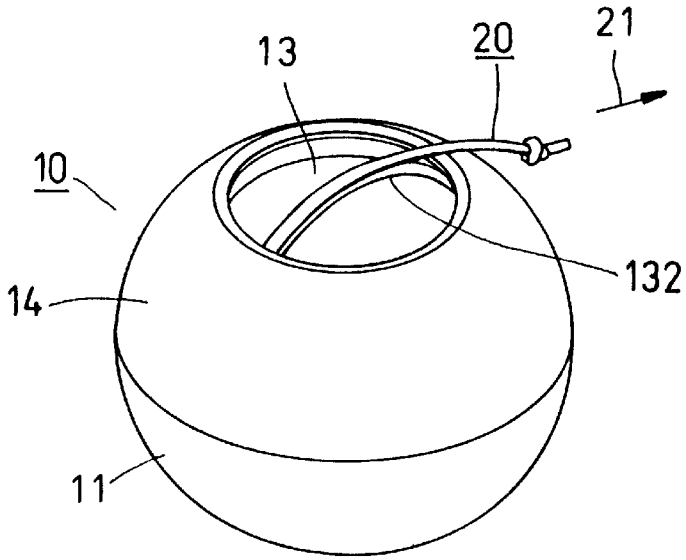
FIG.6 (PRIOR ART)
FIG. 6 is a schematic view showing that the work of winding the cord 20 along the groove 132 of the prior art wrist ball is completed.
Figure 5:
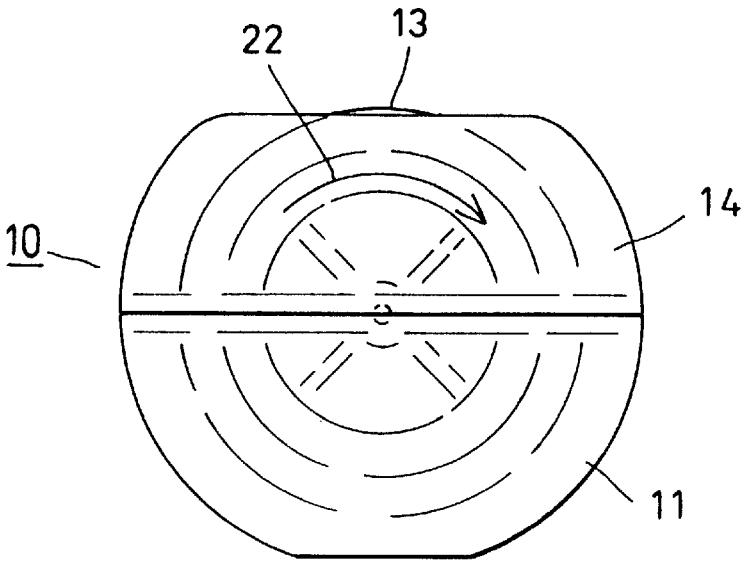
FIG. 5 (PRIOR ART)
FIG. 5 is a schematic view showing that the cord 20 is being wound along a groove 132 of the prior art wrist ball.
Figure 9:
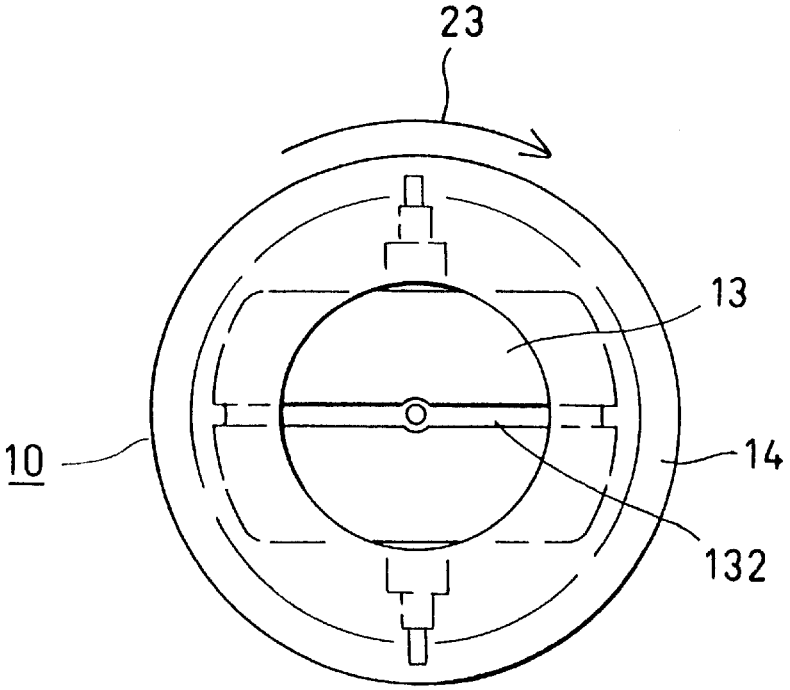
FIG. 9 (PRIOR ART)
FIG. 9 shows a schematic view of the prior art wrist ball at work.
Figure 7:
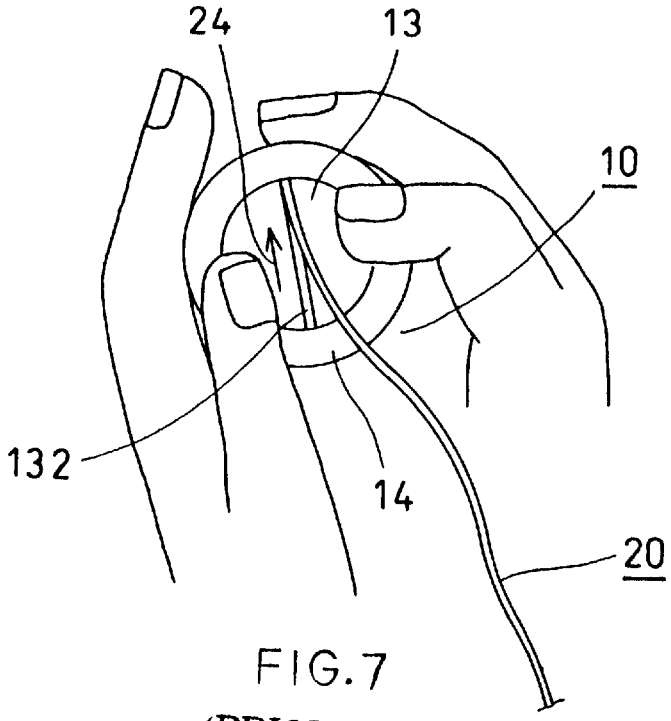
FIG. 7 (PRIOR ART)
FIG. 7 is a side plan view of the prior art wrist ball to show the rotational direction of the prior art wrist ball to shown the rotational direction of the rotary member 13.
Figure 8:
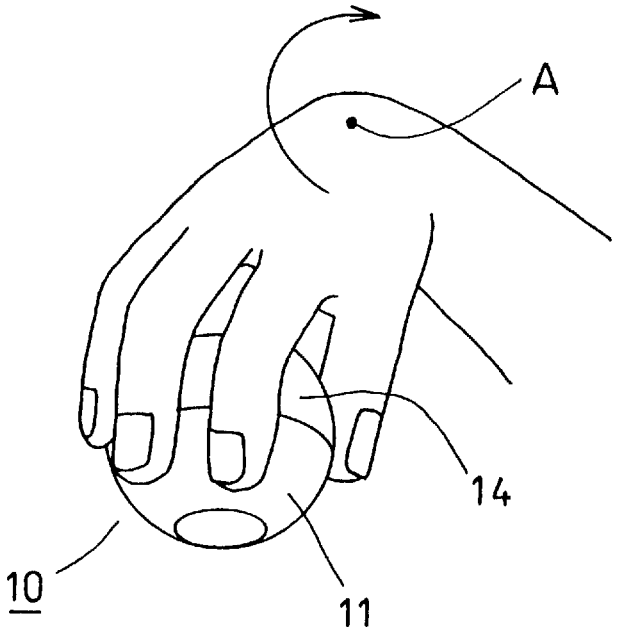
FIG. 8 (PRIOR ART)
FIG. 8 is a top plan view of the prior art wrist ball to show that the rotary member 13 can be actuated to turn in a direction indicated by an arrow 23.
Figure 10:
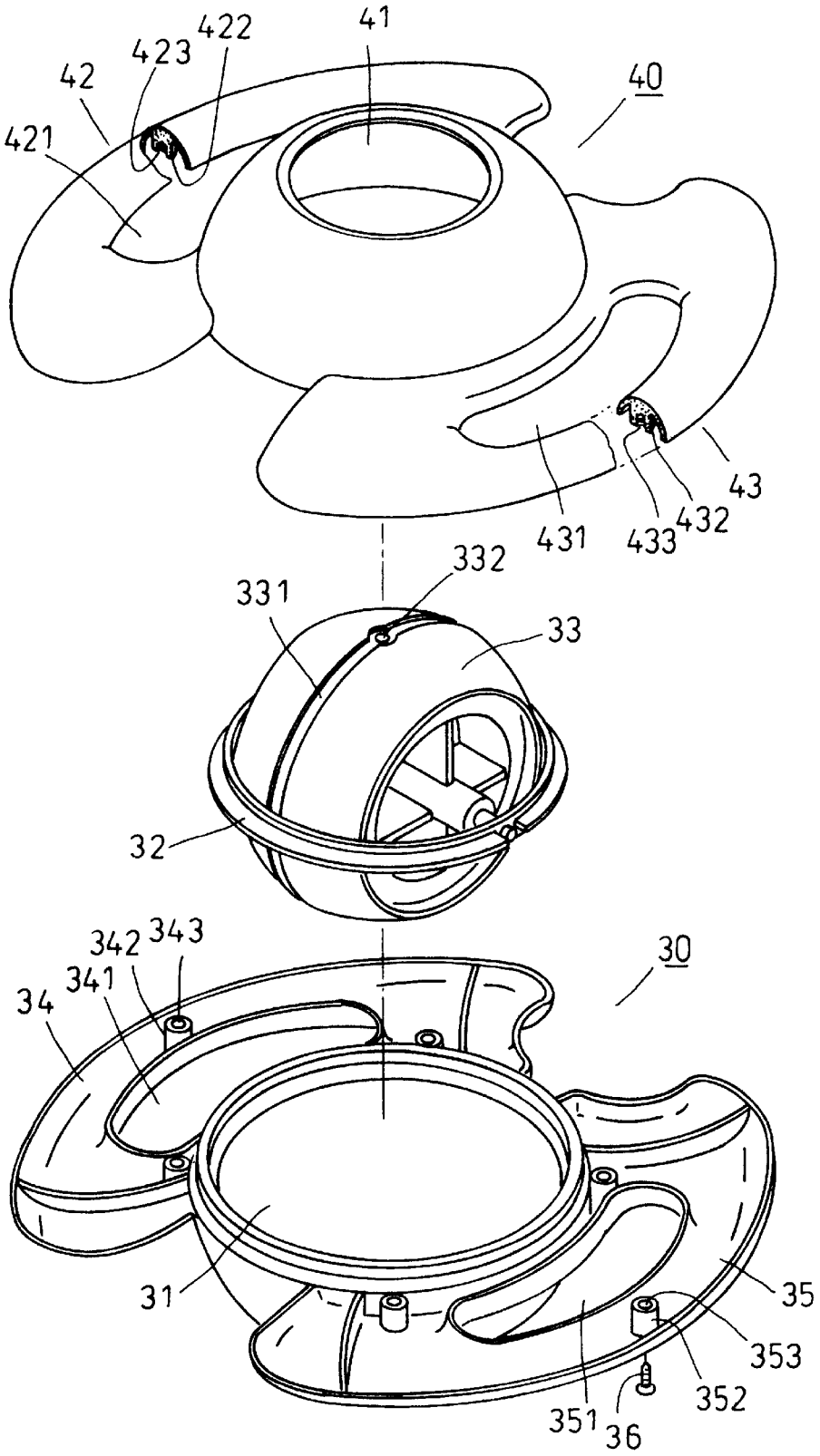
FIG. 10 shows an exploded view of a first preferred embodiment of the present invention.
Figure 11:
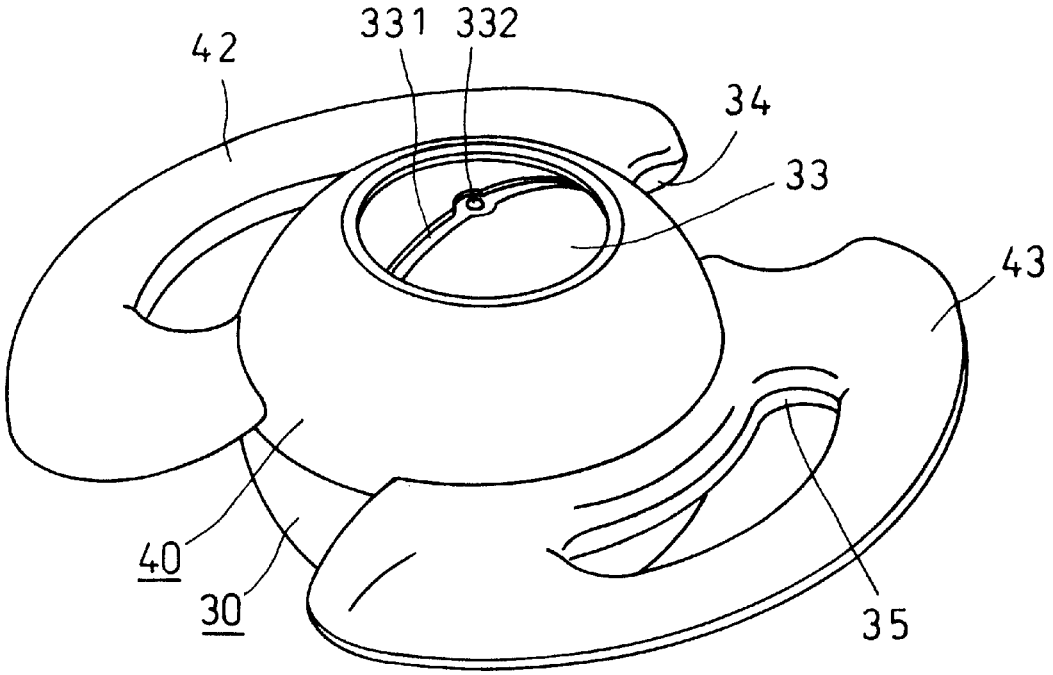
FIG. 11 shows a perspective view of the first preferred embodiment of the present invention in combination.
Figure 12:
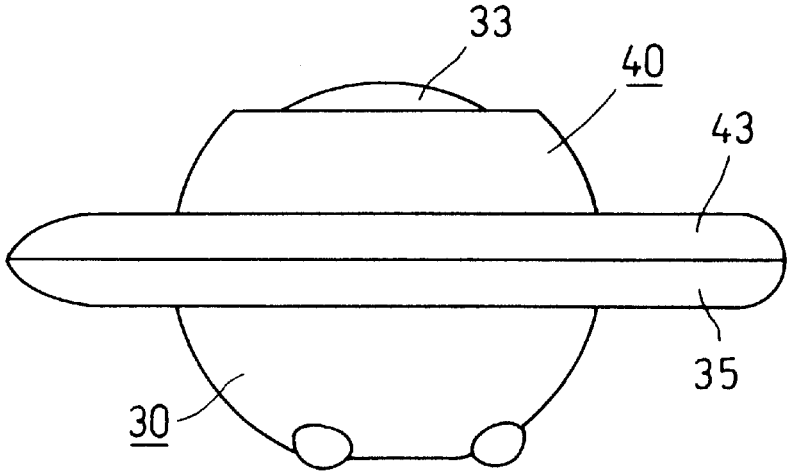
FIG. 12 shows a side plan view of the first preferred embodiment of the present invention as shown in FIG. 11.

As shown in FIGS. 10–12, the present invention comprises a lower shell 30 and an upper shell 40.

The lower shell 30 is made of a plastic material by injection molding and is of a semispherical construction. The lower shell 30 is provided in the interior thereof with a receiving space 31 having an open top. The receiving space 31 is intended to accommodate a support ring 32 and a rotary member 33 which is provided with a trough 331 and a hole 332. The lower shell 30 is provided in both left and right sides thereof with a lower protruded plate member 34 (35). These two lower protruded plate members 34 and 35 extend outwardly and symmetrically and are provided respectively with a first through hole 341 (351) having in the periphery thereof a plurality of first columnar bodies 342 (352) which are provided with a through hole 343 (353) extending from the top to the bottom.

The upper shell 40 is made of a plastic material by injection molding and is provided at the top thereof with an opening 41. The upper shell 40 is provided at both left and right sides thereof with an upper protruded plate member 42 (43) corresponding to the lower protruded plate member 34 (35). The upper protruded plate member 42 (43) is provided with a second through hole 421 (431) opposite to the first through hole 341 (351) and having in the periphery thereof a plurality of second columnar bodies 422 (432). The columnar bodies 422 (432) are provided with a hole 423 (433) of an appropriate depth and extending from the bottom of the columnar bodies to the top of the columnar bodies.

In combination, a plurality of screws 36 are fastened onto from the bottom toward the top such that the screws 36 are first put through the through holes 343 (353) of the first columnar bodies 342 (352), and that the screws 36 are then received in the holes 423 (433) of the second columnar bodies 422 (432). As a result, the upper protruded plate member 42 (43) and the lower protruded plate member 34 (35) are fastened together securely.

Figure 13:
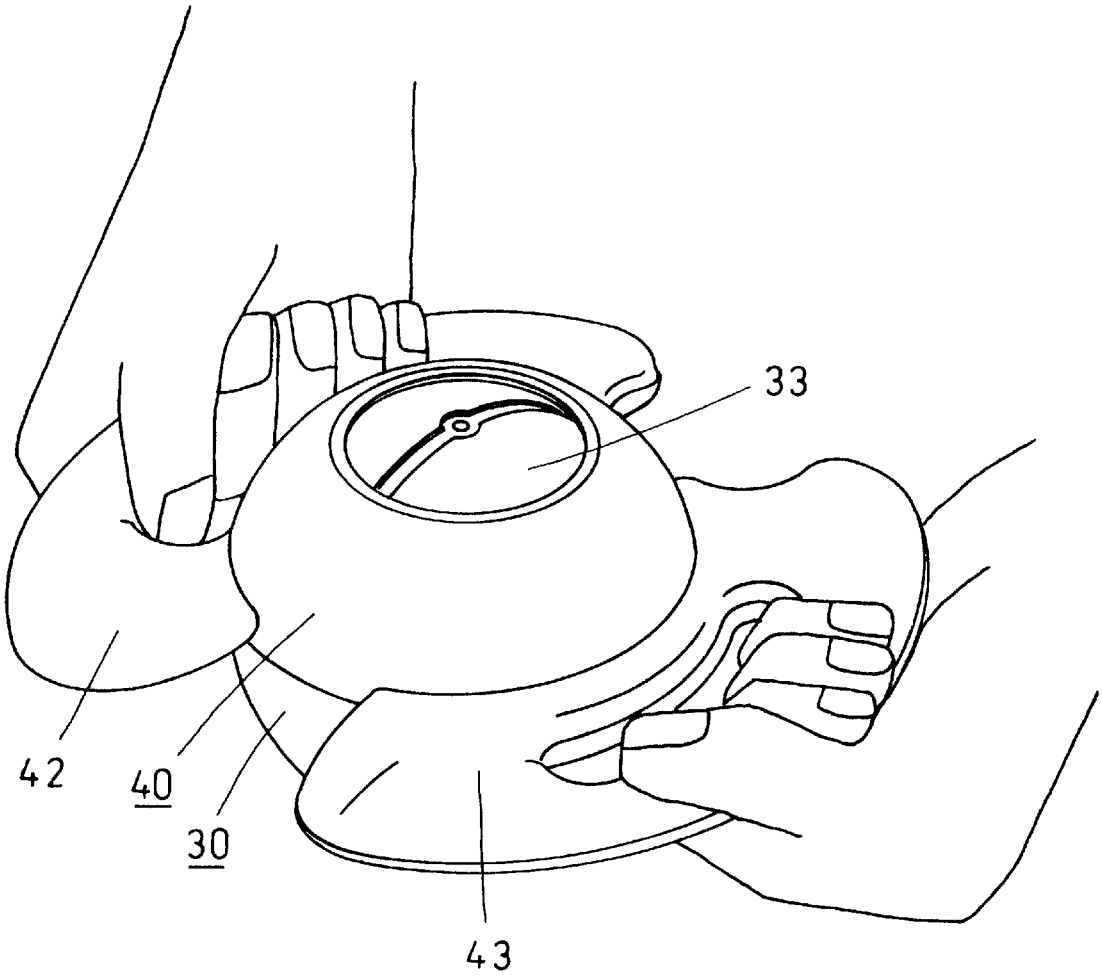
FIG. 13 shows a schematic view of the present invention in use.

The method of using the present invention is similar to that of the prior art in that the head end of a fine cord is inserted into the hole 332 of the rotary member 33 before winding the fine cord in the trough 331. With one hand holding one set of the upper and the lower protruded plate members 43 and 35, the exerciser uses his or her other hand to pull violently the fine cord so as to actuate the rotary member 33. As shown in FIG. 13, other set of the upper and the lower protruded plate members 42 and 34 is held by the other hand. With both hands applying force jointly to rotate along the circumferential track so as to keep the rotary member 33 in the revolving state, both hands are engaged evenly in the exercise.

Figure 14:
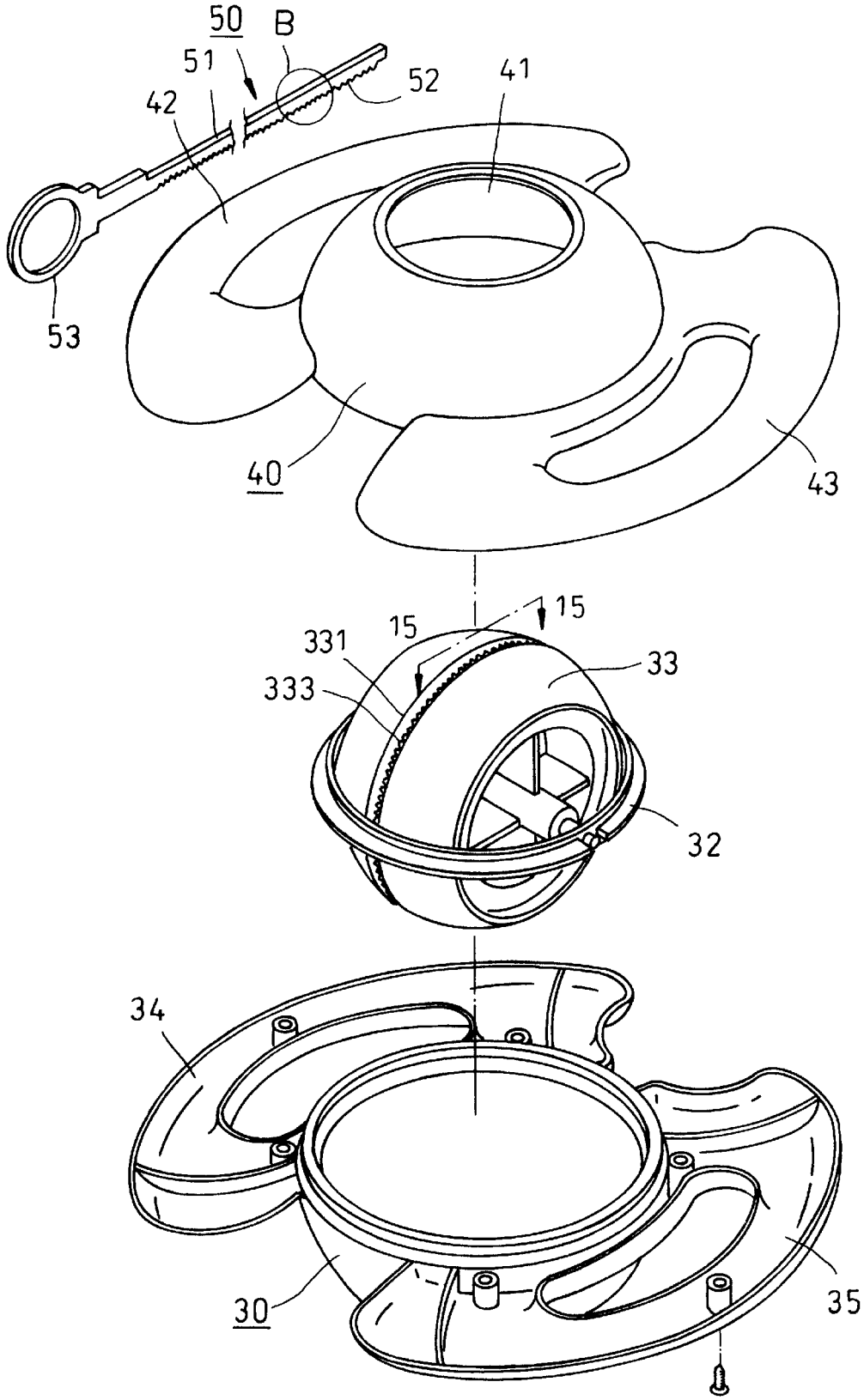
FIG. 14 shows an exploded view of a second preferred embodiment of the present invention.
Figure 16:
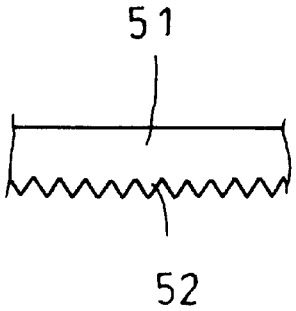
FIG. 16 shows an enlarged view of a "B" portion of a pulling member 50 as shown in FIG. 14.
Figure 15:
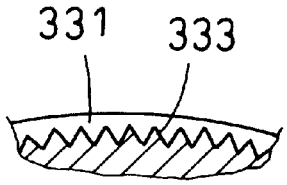
FIG. 15 shows a sectional view of a portion taken along a line 15—15 of a rotary member 33 as shown in FIG. 14.
Figure 17:
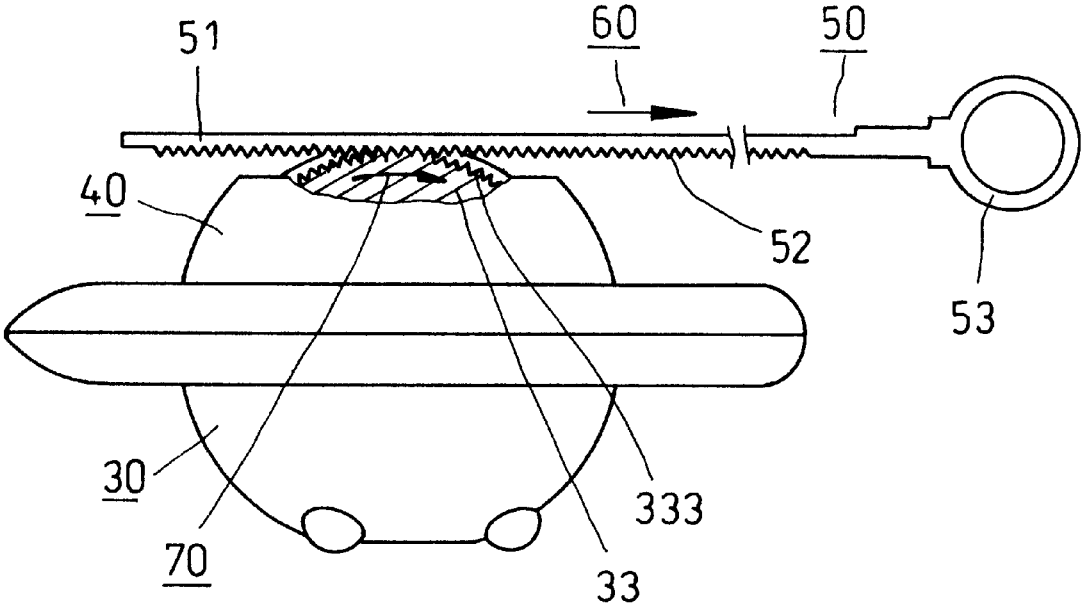
FIG. 17 is a schematic view showing that the rotary member 33 is pulled by the pulling member 50 of the second preferred embodiment of the present invention.

As shown in FIGS. 14–16, the second preferred embodiment of the present invention is different from the first preferred embodiment of the present invention in design in that the trough 331 of the rotary member 33 of the second preferred embodiment is devoid of the holes 332 and is provided in the entire surface of the trough 331 with a first engagement portion 333 of a serrated construction, and that the second preferred embodiment further comprises a pull member 50 which has a long rod portion 51. The long rod portion 51 is provided along the direction of the longitudinal axis thereof with a second engagement portion 52. The long rod portion 51 is provided at the rear end thereof with a grip portion 53. This design is intended to provide another mode of actuating the rotary member 33, as shown in FIG. 17. The second engagement portion 52 of the pull member 50 is meshed with the first engagement portion 333 of the rotary member 33. When the pull member 50 is pulled in the direction indicated by an arrow 60, the rotary member 33 is actuated to turn in the direction indicated by an arrow 70.

What is claimed is:

1. A wrist exerciser comprising:

a lower shell of a semispherical construction and provided therein with a receiving space having an open top whereby said receiving space is intended to accommodate a support ring which is fastened pivotally with a rotary member having in the periphery thereof a trough and an insertion hole; and an upper shell of a hollow semispherical construction and provided in a top thereof with a round opening;

wherein said lower shell is provided with two lower protruded plate members extending therefrom symmetrically and having a first through hole whereby said first through hole is provided in a periphery thereof with a plurality of first columnar bodies, each having a through hole;

wherein said upper shell is provided with two upper protruded plate members corresponding to said lower protruded plate members and having a second through hole opposite to said first through hole whereby said second through hole is provided in a periphery thereof with a plurality of second columnar bodies, each having a hole of a depth;

said upper protruded plate members and said lower protruded plate members being fastened together by a plurality of fastening screws whereby said screws are fastened into said holes of said second columnar bodies via said through holes of said first columnar bodies.

* * * * *